US005928002A

United States Patent [19]

Loibl

[11] Patent Number: 5,928,002

[45] Date of Patent: Jul. 27, 1999

[54] METHOD AND DEVICE FOR CONNECTING A FLEXIBLE FLAT CABLE TO A CONTACT TONGUE DISPOSED ON AND PROTRUDING FROM A BASE PLATE

[75] Inventor: Josef Loibl, Regen, Germany

[73] Assignee: Siemens Aktiengesellschaft, Munich, Germany

[21] Appl. No.: 09/059,101

[22] Filed: Apr. 13, 1998

[30] Foreign Application Priority Data

Apr. 11, 1997 [DE] Germany ..... 197 15 128

[51] Int. Cl.[6] ..... H01R 9/09

[52] U.S. Cl. ..... 439/67; 439/493

[58] Field of Search ..... 439/67, 77, 493, 439/632

[56] References Cited

U.S. PATENT DOCUMENTS

| | | | |
|---|---|---|---|
| 3,533,049 | 10/1970 | Thomson | 439/77 |
| 3,980,375 | 9/1976 | LaMarche | 439/593 |
| 4,573,752 | 3/1986 | Rich | 439/77 |
| 4,808,113 | 2/1989 | Kenisige et al. | 439/493 |

FOREIGN PATENT DOCUMENTS

| | | |
|---|---|---|
| 0759650A2 | 2/1997 | European Pat. Off. . |
| 1665171 | 7/1977 | Germany . |
| 9102716 | 7/1991 | Germany . |

*Primary Examiner*—Neil Abrams
*Assistant Examiner*—T C Patel
*Attorney, Agent, or Firm*—Herbert L. Lerner; Laurence A. Greenberg

[57] ABSTRACT

A device for contacting a contact tongue has a counterpart contact body, made of plastic and formed with a slot space for receiving the contact tongue. On the side of the counterpart contact body pointing toward the contact tongue, a flexible conductor foil is provided which, when the counterpart contact body is slipped into the contact tongue, is forced by the contact tongue against the inner wall of the slot space and thereby contacts the contact tongue.

7 Claims, 1 Drawing Sheet

METHOD AND DEVICE FOR CONNECTING A FLEXIBLE FLAT CABLE TO A CONTACT TONGUE DISPOSED ON AND PROTRUDING FROM A BASE PLATE

BACKGROUND OF THE INVENTION

1. Field of the Invention

The invention relates to a method of contacting a contact tongue disposed on a base plate and protruding from it with a flexible flat cable, wherein a counterpart contact body formed with a slot space for receiving the contact tongue is slipped onto the contact tongue. The invention also pertains to a corresponding device.

As motor vehicles are increasingly equipped with electrical and electronic controls, plug-type connections are increasingly gaining in significance. The most various demands are made of these plug connections in terms of current carrying capacity, contact resistance, mechanical and thermal load-bearing capacity, and so forth.

The problem frequently arises of how to electrically contact a contact tongue or contact lug which protrudes from a component unit, such as a control unit, an electrically controlled transmission, and so forth. It is typical for a slotted counterpart contact, for instance comprising a copper alloy, to be slipped or mounted onto the contact tongue. The counterpart contact itself provides the electrical contacting and either is a component of a plug with a plurality of counterpart contacts or it is a single counterpart contact. The counterpart contact is connected to an electrical cable conductor by soldering, crimping or the like. Producing such mechanical counterpart contacts and connecting them to connection lines is relatively complicated, and thus expensive. Moreover, there are contact resistors between the counterpart contacts and the connection lines, which demands careful quality-assurance provisions so as not to impair the reliability of operation.

U.S. Pat. No. 4,573,752 to Rich defines the generic flat cable connection system. There, a contact tongue with which a flat cable is connected has a plurality of contact tongues, which are disposed on a base plate and protrude from it. Each contact tongue has a receiving slot with contact regions that face one another. A flat cable is fixed in a counterpart contact body of plastic and when the counterpart contact body is mounted on the contact tongues, the cable is introduced into the receiving slot in such a way that a disconnectible electrical contact is brought about via the contact regions between the contact tongues and the conductors of the flat cable.

A device for contacting a flexible flat cable with a connector has also become known from European patent disclosure EP 0 759 650 A2. There, the flat cable is deformed by the slipping on of a fastening body and is pressed against the side walls of the connector in such a way as to produce contacting.

Devices for connecting a flexible flat cable to the contact tongues of a connector are further described in German published, examined patent application DE-AS 16 65 171 and German Utility Model DE 91 02 716 U1. There, the flat cable is pressed by a counterpart contact into the slot space of the connector in such a way that an electrical contact is formed.

2. Summary of the Invention

The disadvantages of the prior art devices can advantageously be avoided by contacting the contact tongues with a special type of flat cables, known as flexible conductor films or foils.

It is accordingly an object of the invention to provide a method and a device for contacting, with a flat cable, a contact tongue projecting from a flat base plate, which overcomes the disadvantages of the prior art devices and methods of this general type and which provides for a reliable contact with the contact tongue.

With the foregoing and other objects in view there is provided, in accordance with the invention, a method of connecting a flexible flat cable with a contact tongue disposed on and protruding from a base plate, which comprises:

providing a flexible conductor foil having at least one conductor track and placing the conductor foil between a contact tongue and a counterpart contact body, the counterpart contact body being formed with a slot space defining an inner wall;

slipping the counterpart contact body onto the contact tongue and deforming the flexible conductor foil by pressing the flexible conductor foil against the inner wall of the slot space and forming an electrical contact between the at least one conductor track of the flexible conductor foil and the contact tongue.

With the above objects in view there is also provided a flat cable connector, comprising:

a contact tongue disposed on and protruding from a base plate;

a counterpart contact body comprising plastic material and having a slot space with an inner wall formed therein for receiving the contact tongue;

a flexible conductor foil disposed between the contact body and the contact tongue, the contact tongue, upon insertion into the slot space of the contact body, forcing the flexible conductor foil against the inner wall of the slot space and effecting an electrical contact between the flexible conductor foil and the contact tongue.

It is an essential feature of the invention that the counterpart contact body is optimally adapted to suit the purpose—the body may be a simple injection-molded plastic part—and, when the counterpart contact body is slipped onto the contact tongue to be contacted, a flexible conductor foil is pressed by the contact tongue so that it rests against the inner wall of the slot. This closes the electrical connection between the contact tongue and the flexible conductor foil. No metal counterpart contact whatever is necessary. By means of the flexible conductor foil, the contact tongue is securely contacted, and the plastic contact body provides the retention of the flexible conductor foil on the contact tongue. With the flexible conductor foil, the contact tongue is connected directly to a vehicle electric system, for instance, if the contact tongue is used to supply current to a consumer, such as a transmission actuator, or if it is a component of an electronic control unit, so that the necessary control signal is carried via the contact tongue.

In accordance with an added feature of the invention, the inner wall of the slot space has two mutually parallel wall surfaces each formed with a protruding edge extending along a slip-on direction along which the contact body is slipped onto the contact tongue and facing towards one another, the protruding edges receiving the contact tongue therebetween.

In accordance with another feature of the invention, the slot space has a beveled mouth opening widening towards the contact tongue.

In accordance with an additional feature of the invention, the contact tongue is one of a plurality of mutually adjacent contact tongues, and wherein the flexible conductor foil is formed with a plurality of conductor tracks assigned to respective the contact tongues, the slot space being adapted to receive the plurality of contact tongues with an intermediary of the conductor tracks of the conductor foil.

In accordance with a concomitant feature of the invention, the two mutually opposite inner walls receiving the contact tongue therebetween and the flexible conductor foil are elastically resilient.

Other features which are considered as characteristic for the invention are set forth in the appended claims.

Although the invention is illustrated and described herein as embodied in a method and device for contacting a contact tongue, disposed on a base plate and protruding from it, with a flexible flat cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
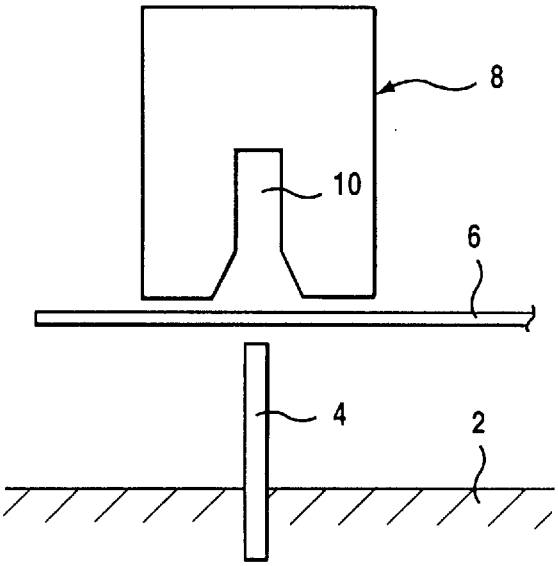
FIG. 1 is an exploded elevational view of a device for contacting a contact tongue.

Referring now to the figures of the drawing in detail and first, particularly, to FIG. 1 thereof, there is seen a contact tongue 4 which projects upwardly from a base plate 2. The base plate 2 may, for example, be a connection plate for electrically connecting a transmission. The contact tongue may be a conventional flat rectangular metal part. The thickness of the contact tongue 4 is such that it has adequate intrinsic stiffness so that a counterpart contact can be slipped onto it.

The contact tongue 4 is contacted to a flexible conductor foil 6. Flexible conductor foils of this kind are known in the art. They comprise, for instance, a polyimide film onto which a conductive copper layer is applied by means of an adhesive, such as an acrylic adhesive, and the copper layer may in turn be silver-coated. Flexible conductor foils of this kind are very flexible without incurring damage to the electrical conductor tracks.

In order to place the flexible conductor foil 6 into electrically contacting physical contact with the contact tongue 4, a counterpart contact body 8 is provided, which comprises plastic, such as PA6.6. The contact body 8 is formed with a slot 10 which widens conically at its opening.

Figure 2:
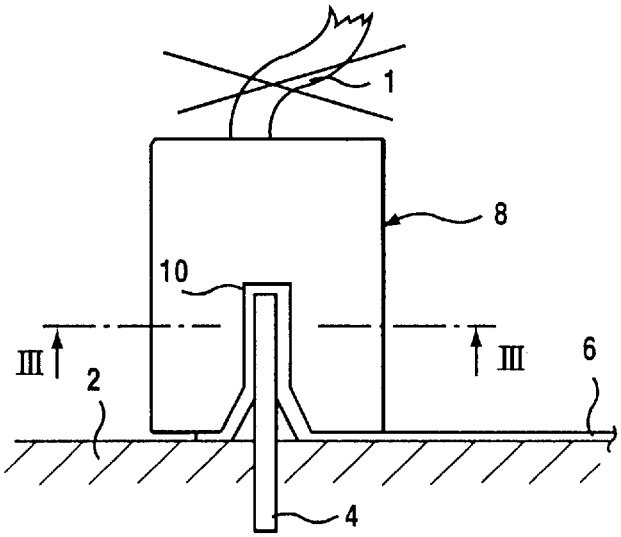
FIG. 2 is an elevational view of the system of FIG. 1 in the assembled state.

FIG. 2 shows the configuration of FIG. 1 in the assembled state. Here, the counterpart contact body 8 has been slipped onto the contact tongue 4, with the interposition of the flexible conductor foil, in such a way that the contact tongue 4 is received in the slot space 10. The flexible conductor foil is disposed between the inner wall of the slot space 10 and the contact tongue 4, wrapping around the contact tongue 4. The slot space 10 is dimensioned such that the flexible conductor foil is under pressure between the inner wall of the slot space 10 and the contact tongue 4. That contact pressure is purposefully increased by providing that the inner wall of the slot space 10, in the region of the contact tongue 4, is formed with a protruding edge 12 (FIG. 3) on each side. These protruding edges 12 assure that the conductor material of the flexible conductor foil will come into immediate intimate physical contact with the contact tongue 4.

Figure 3:
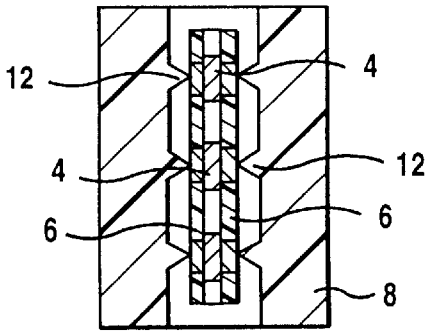
FIG. 3 is a sectional view of the system of FIG. 2, taken along the line III—III of FIG. 2 and viewed in the direction of the arrows.

With reference to FIG. 3, three contact tongues 4 disposed side by side protrude into the slot space 10, and one conductor track of the flexible conductor foil is assigned to each of the contact tongues 4.

It will be appreciated by those of skill in the art that the system shown and described above may be modified in manifold ways:

The contact tongue, which is shown as a flat part in the drawings, may also be a contact tongue of elliptical or round cross section or a contact pin. The slot opening need merely be adapted to the cross section such that the flexible conductor foil comes into secure contact with the contact part on at least one side.

The counterpart contact body 8 may be provided with fastening flanges which are screwed to the base plate 2, thus producing a mechanically stable, hermetically sealed connection between the contact tongue 4 and the flexible conductor foil 6.

The counterpart contact body may be part of a housing or supporting body which, among other elements, receives electronic circuits.

The flexible conductor foil 6 may be secured to the counterpart contact body 8, preferably at the end of the slot space 10 remote from its free end, by adhesive bonding, for instance and it may additionally be positioned by guides, which makes manipulation easier. The entire configuration may be embodied such that the counterpart contact body 8, with the associated flexible conductor foil, forms a multiple plug for connecting many contact tongues. The counterpart contact body may be embodied such that its legs on both sides of the slot space 10 are elastically resilient. In this way, the counterpart contact body, with the flexible conductor foil received in its slot space 10, can be lifted from the contact tongue 4 and slipped back on again. This elastic resilience can be attained by means of the shaping of the overall counterpart contact body, or by making the counterpart contact body multilayered adjacent to the inner walls of the slot space. In that case an elastically deformable layer of foamed material, for instance, is provided.

The edges, or the ribs ending in the edges, on the inside of the slot space may be dimensioned such that when the counterpart contact body is slipped on they deform plastically in a purposeful way, so as to assure a high contact-pressure force. In that case, however, the counterpart contact body cannot be removed from the contact tongue and slipped back on again without threatening the quality of the contact.

I claim:

1. A method of contacting a contact tongue disposed on and protruding from a base plate, which comprises:

providing a flexible conductor foil having at least one conductor track and placing the conductor foil between a contact tongue and a counterpart contact body, the counterpart contact body being formed with a slot space defining an inner wall;

wrapping the flexible conductor foil around the contact tongue by slipping the counterpart contact body onto the contact tongue and deforming the flexible conductor foil by pressing the flexible conductor foil against the inner wall of the slot space and forming an electrical contact between the at least one conductor track of the flexible conductor foil and the contact tongue.

2. A connector, comprising:

a contact tongue disposed on and protruding from a base plate;

a counterpart contact body comprising plastic material and having a slot space with an inner wall formed therein for receiving said contact tongue;

a flexible conductor foil wrapped around said contact tongue and disposed between said contact body and said contact tongue, said contact tongue, upon insertion into said slot space of said contact body, forcing said flexible conductor foil against said inner wall of said slot space and effecting an electrical contact between said flexible conductor foil and said contact tongue.

3. The device according to claim 2, wherein said inner wall of said slot space has two mutually parallel wall surfaces each formed with a protruding edge extending along a slip-on direction along which said contact body is slipped onto said contact tongue and facing towards one another, said protruding edges receiving said contact tongue therebetween.

4. The device according to claim 2, wherein said slot space has a beveled mouth opening widening towards said contact tongue.

5. The device according to claim 2, wherein said contact tongue is one of a plurality of mutually adjacent contact tongues, and wherein said flexible conductor foil is formed with a plurality of conductor tracks assigned to respective said contact tongues, said slot space being adapted to receive said plurality of contact tongues with an intermediary of said conductor tracks of said conductor foil.

6. The device according to claim 2, wherein said inner wall of said slot space has two mutually opposite inner wall surfaces receiving said contact tongue therebetween, and wherein said mutually opposite inner wall surfaces and said flexible conductor foil are elastically resilient.

7. A connector for contacting a contact tongue disposed on and protruding from a base plate, the connector comprising:

a counterpart contact body comprising plastic material and having a slot space with an inner wall formed therein for receiving a contact tongue;

a flexible conductor foil wrapped around the contact tongue and disposed between said contact body and the contact tongue, the contact tongue, upon insertion into said slot space of said contact body, forcing said flexible conductor foil against said inner wall of said slot space and effecting an electrical contact between said flexible conductor foil and the contact tongue.

* * * * *